US012385348B2

(12) United States Patent
Katanguri et al.

(10) Patent No.: US 12,385,348 B2
(45) Date of Patent: Aug. 12, 2025

(54) ANNULAR CLOSING SYSTEM AND METHOD FOR USE IN BLOWOUT PREVENTER

(71) Applicant: Schlumberger Technology Corporation, Sugar Land, TX (US)

(72) Inventors: Suman Katanguri, Sugar Land, TX (US); Bruce Boulanger, Sugar Land, TX (US); Gerrit Kroesen, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 26 days.

(21) Appl. No.: 18/327,382

(22) Filed: Jun. 1, 2023

(65) Prior Publication Data

US 2024/0401428 A1 Dec. 5, 2024

(51) Int. Cl.
*E21B 33/06* (2006.01)

(52) U.S. Cl.
CPC ..... *E21B 33/063* (2013.01)

(58) Field of Classification Search
CPC ..... E21B 33/06; E21B 33/063
See application file for complete search history.

(56) References Cited

U.S. PATENT DOCUMENTS

| | | | |
|---|---|---|---|
| 1,839,394 | A | 1/1932 | Inge |
| 2,855,172 | A | 10/1958 | Jones |
| 3,321,217 | A | 5/1967 | Ahlstone |
| 4,095,805 | A | 6/1978 | Allen |
| 4,372,026 | A | 2/1983 | Mosing |
| 4,458,876 | A | 7/1984 | Schaeper |
| 4,715,456 | A | 12/1987 | Poe, Jr. |
| 6,998,724 | B2 | 2/2006 | Johansen et al. |
| 7,156,183 | B2 | 1/2007 | Williams |
| 7,159,662 | B2 | 1/2007 | Johansen et al. |
| 7,395,855 | B2 | 7/2008 | Ayling |
| 7,779,918 | B2 | 8/2010 | Cowie |
| 7,798,466 | B2 | 9/2010 | Springett et al. |
| 8,316,872 | B1 | 11/2012 | Milanovich |
| 8,381,819 | B2 | 2/2013 | Fern et al. |
| 8,621,958 | B2 | 1/2014 | Biester |
| 8,657,011 | B2 | 2/2014 | Vyas et al. |
| 8,776,892 | B2 | 7/2014 | Fern et al. |
| 9,019,118 | B2 | 4/2015 | Milne et al. |

(Continued)

FOREIGN PATENT DOCUMENTS

| | | |
|---|---|---|
| EP | 2864579 A1 | 4/2015 |
| EP | 3039226 A2 | 7/2016 |

(Continued)

*Primary Examiner* — Paul J Gray
(74) *Attorney, Agent, or Firm* — Jeffrey D. Frantz

(57) ABSTRACT

A technique facilitates reliable operation of a blowout preventer (BOP) system in a wide range of challenging environments. To enable dependable and rapid closing of the internal passageway of the BOP system, an electronically actuated annular closing system is employed. The annular closing system may include, for example, a packer combined with a shift mechanism actuatable to compress the packer inwardly so as to seal off the internal passageway. An electronic actuator is coupled with the shift mechanism to enable selective actuation of the shift mechanism to achieve the sealed closing of the internal passageway.

12 Claims, 10 Drawing Sheets

(56) References Cited

U.S. PATENT DOCUMENTS

| | | | |
|---|---|---|---|
| 9,388,657 | B2 | 7/2016 | Nelson |
| 9,388,888 | B2 | 7/2016 | Eriksen |
| 9,494,007 | B2 | 11/2016 | Bourgeau et al. |
| 9,581,266 | B2 | 2/2017 | Eriksen |
| 9,627,940 | B2 | 4/2017 | Eriksen |
| 9,631,455 | B2 | 4/2017 | Geiger et al. |
| 9,797,216 | B2 | 10/2017 | Rosa et al. |
| 9,822,600 | B2 | 11/2017 | Bourgeau et al. |
| 10,287,841 | B2 | 5/2019 | Zonoz et al. |
| 10,301,897 | B2 | 5/2019 | Arteaga et al. |
| 10,316,605 | B2 | 6/2019 | Bourgeau et al. |
| 10,329,865 | B1 | 6/2019 | Baugh |
| 10,370,914 | B2 | 8/2019 | Angstmann et al. |
| 10,415,339 | B2 | 9/2019 | Garro et al. |
| 10,465,466 | B2 | 11/2019 | Angstmann et al. |
| 10,487,587 | B2 | 11/2019 | Cummins |
| 10,570,689 | B2 | 2/2020 | Jaffrey |
| 10,597,966 | B2 | 3/2020 | Jones et al. |
| 10,648,268 | B2 | 5/2020 | Jaffrey et al. |
| 10,689,933 | B2 | 6/2020 | Deul et al. |
| 10,724,324 | B2 | 7/2020 | Boulanger |
| 10,801,292 | B2 | 10/2020 | Biester et al. |
| 10,900,347 | B2 | 1/2021 | Amsellem et al. |
| 11,060,372 | B2 | 7/2021 | Bourgeau et al. |
| 11,066,892 | B2 | 7/2021 | Gallagher et al. |
| 11,098,551 | B2 | 8/2021 | Angstmann et al. |
| 11,136,853 | B2 | 10/2021 | Zonoz et al. |
| 11,156,054 | B2 | 10/2021 | Alsup et al. |
| 11,339,624 | B2 | 5/2022 | Angstmann et al. |
| 2004/0056229 | A1 | 3/2004 | Biester |
| 2010/0006298 | A1 | 1/2010 | Voss |
| 2013/0175045 | A1 | 7/2013 | Rytlewski |
| 2013/0199801 | A1 | 8/2013 | Johnson |
| 2013/0199802 | A1 | 8/2013 | Weir |
| 2013/0220637 | A1* | 8/2013 | Fabela ..... E21B 31/18 166/382 |
| 2014/0354096 | A1 | 12/2014 | Eriksen |
| 2015/0152705 | A1 | 6/2015 | Andrew et al. |
| 2016/0290526 | A1 | 10/2016 | Easter et al. |
| 2017/0058623 | A1 | 3/2017 | Jaffrey |
| 2017/0130562 | A1 | 5/2017 | Andrew et al. |
| 2017/0218717 | A1 | 8/2017 | Brinsden |
| 2019/0145217 | A1 | 5/2019 | Alsup et al. |
| 2019/0338614 | A1 | 11/2019 | Angstmann et al. |
| 2020/0115987 | A1 | 4/2020 | Rome |
| 2021/0180427 | A1 | 6/2021 | Zonoz |
| 2021/0189826 | A1 | 6/2021 | Gallagher et al. |
| 2021/0340833 | A1 | 11/2021 | Angstmann et al. |
| 2021/0372224 | A1 | 12/2021 | Tyler |
| 2022/0136356 | A1 | 5/2022 | Poveda et al. |
| 2022/0389784 | A1 | 12/2022 | Katanguri et al. |

FOREIGN PATENT DOCUMENTS

| | | | |
|---|---|---|---|
| EP | 3099934 | A1 | 12/2016 |
| EP | 3822514 | A1 | 5/2021 |
| GB | 2517959 | A | 3/2015 |
| NO | 343133 | B1 | 11/2018 |
| WO | 2017042152 | A1 | 3/2017 |

* cited by examiner

ANNULAR CLOSING SYSTEM AND METHOD FOR USE IN BLOWOUT PREVENTER

BACKGROUND

In many oil and gas well applications, various types of equipment may be used to contain and isolate pressure in the wellbore. For example, a blowout preventer system may be installed on a wellhead to protect against blowouts. The blowout preventer has a longitudinal interior passage which allows passage of pipe, e.g. drill pipe, and other well components. Additionally, the blowout preventer has a variety of features including rams, e.g. pipe rams and shear rams, which facilitate rapid well sealing operations. Control over operation of the blowout preventer generally is achieved with various types of hydraulic controls. However, as deeper subsea wells and other types of deep wells are developed, the blowout preventer systems are required to operate in more challenging environments while at the same time improving operational availability. These challenging environments and increased requirements can render the hydraulic operating system susceptible to failure.

SUMMARY

In general, a system and method facilitate reliable operation of a blowout preventer (BOP) system in a wide range of challenging environments. To enable dependable and rapid closing of the internal passageway of the BOP system, an electronically actuated annular closing system is employed. The annular closing system may comprise, for example, a packer combined with a shift mechanism actuatable to compress the packer inwardly so as to seal off the internal passageway. An electronic actuator is coupled with the shift mechanism to enable selective actuation of the shift mechanism to achieve the sealed closing of the internal passageway.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The disclosure herein generally involves a system and method which facilitate reliable operation of a blowout preventer (BOP) system in a wide range of challenging environments. For example, the BOP system may be employed in various challenging surface environments and in deep subsea environments where the BOP system is used to seal, control, and monitor a hydrocarbon well. Reliable operation in these types of environments is enhanced by constructing the BOP system as an electrically actuated system.

For example, to enable dependable and rapid closing of an internal passageway of the BOP system, an electronically actuated annular closing system is employed. The annular closing system may comprise, for example, a packer combined with a shift mechanism actuatable to compress the packer inwardly so as to seal off the internal passageway. An electronic actuator is coupled with the shift mechanism to enable selective actuation of the shift mechanism to achieve the sealed closing of the internal passageway.

In a specific embodiment, the annular closing system is in the form of an electric annular system that works by having a rotational plate activated by at least one externally mounted electronic actuator, e.g. an externally mounted electric bonnet assembly, which rotates the rotational plate. According to some applications, the rotational plate may be rotated about a wellbore axis. The rotational movement causes a plurality of inserts to translate and rotate inwardly against a packer. In some embodiments, the inserts may rotate inwardly against a donut surrounding the packer. The movement of the inserts squeezes the donut radially inward toward the packer which, in turn, collapses the packer inwardly against an internal pipe or to the borehole centerline. This packer movement in response to squeezing of the donut seals off the borehole. It should be noted various other types of mechanisms, components, and internal configurations may be utilized in enabling the electrically powered actuation.

Figure 1:
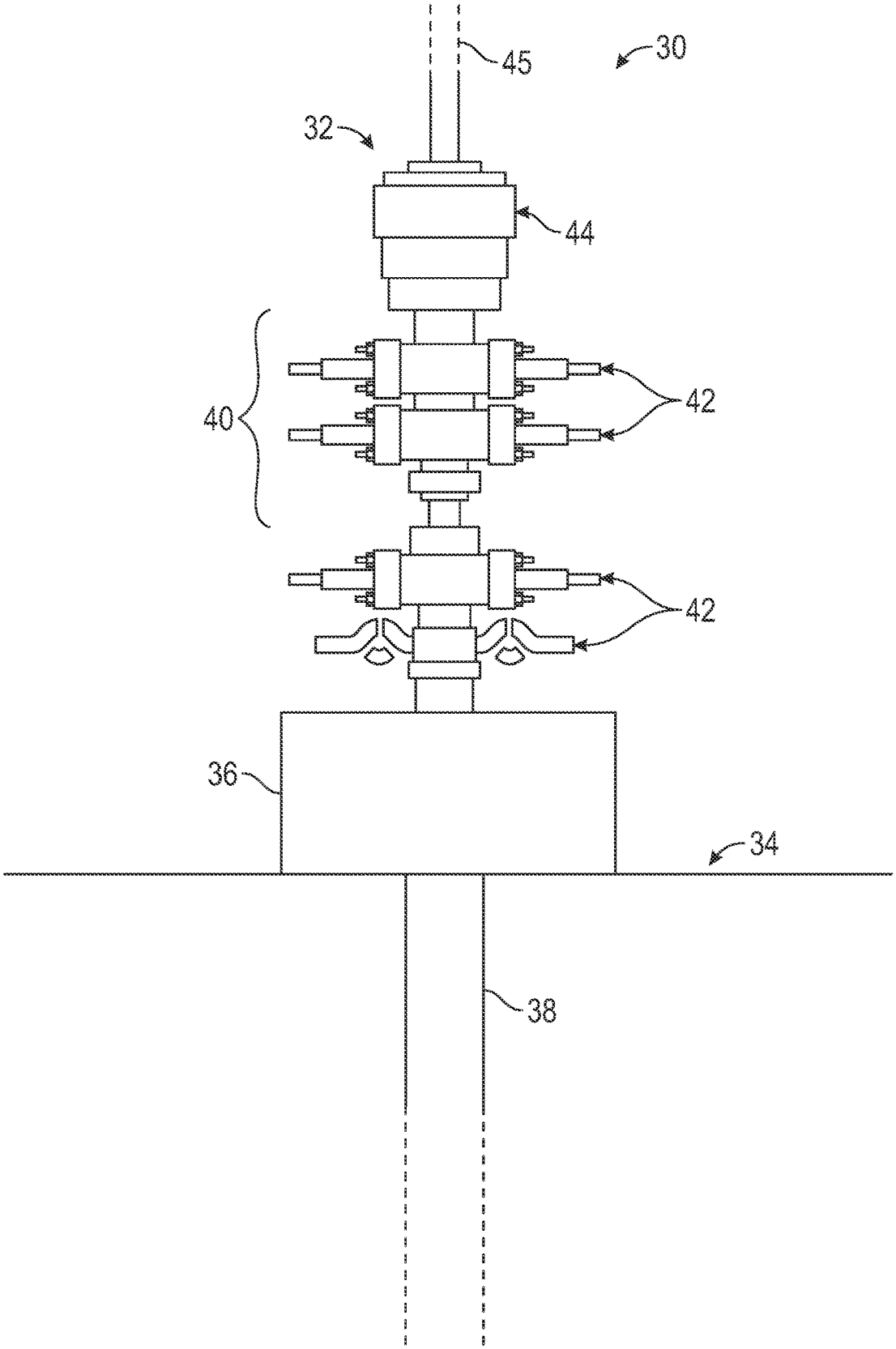
FIG. 1 is an illustration of an example of an annular closing system implemented in an overall well BOP system mounted on a wellhead above a borehole, according to an embodiment of the disclosure.

Referring generally to FIG. 1, a well system 30 is illustrated as comprising a BOP system 32 for providing pressure control at a well 34. In this example, the BOP system 32 is mounted on a wellhead 36, e.g. a land-based wellhead or a subsea wellhead, located above a borehole 38, e.g. a wellbore. The BOP system 32 may be arranged as a BOP stack 40 and may comprise a variety of BOP components, such as ram BOPs 42 and an annular closing system 44. By way of example, the ram BOPs 42 may comprise pipe rams and shear rams. Additionally, the annular closing system 44 may be mounted above the ram BOPs 42. As described below, the BOP system 32 may have a central, longitudinal passage for receiving tubular components 45, e.g. drill pipe or other pipe, therethrough. The annular closing system 44 is in the form of an electronically actuated annular closing system.

Figure 2:
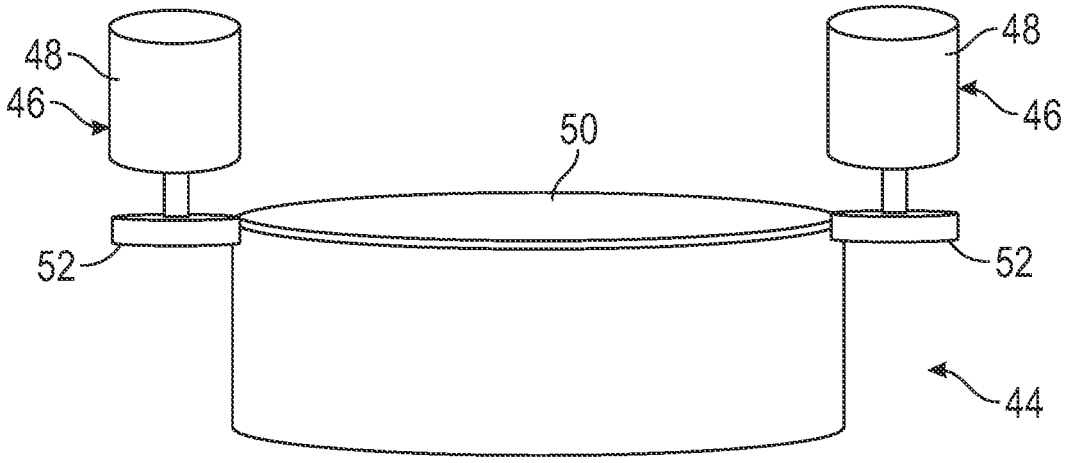
FIG. 2 is a schematic illustration of an example of an annular closing system, according to an embodiment of the disclosure.

Referring generally to FIG. 2, one example of an electronic annular closing system 44 is illustrated schematically as being actuatable via at least one electronic actuator 46. In this particular embodiment, the annular closing system 44 comprises a plurality of electronic actuators 46, e.g. two electronic actuators, mounted at one end of the annular closing system 44.

For example, each electronic actuator 46 may comprise an electric motor 48 connected to a shift mechanism 50 which may be shifted to cause closure of the BOP system central passageway. Electric motors 48 may comprise gears 52 or other actuation mechanisms which interact with the shift mechanism 50 to, for example, rotate the shift mechanism 50 when the gears 52 are rotated via electric motors 48.

Figure 3:
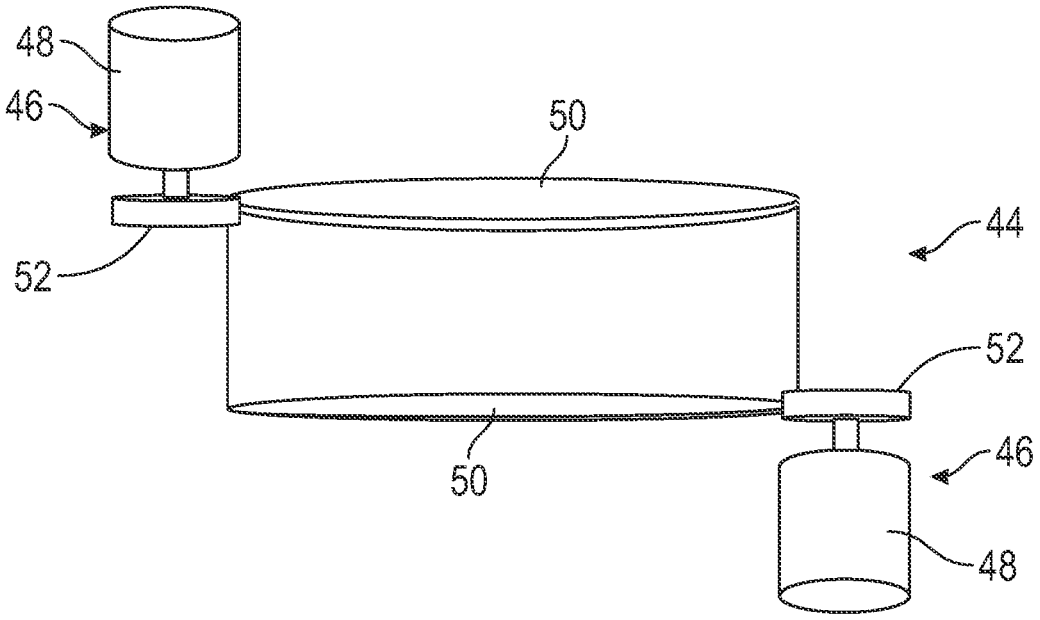
FIG. 3 is a schematic illustration of another example of an annular closing system, according to an embodiment of the disclosure.

In another embodiment illustrated in FIG. 3, at least one electronic actuator 46 is located on each end of the annular closing system 44. In this example, the electronic actuators 46 may again comprise electric motors 48 (or other suitable electric actuators) coupled with corresponding shift mechanisms 50. The motors 48 may be operated to rotate the shift mechanisms 50 so as to cause the desired sealing and closing of the BOP system central passageway at both ends of the annular closing system 44.

Figure 4:
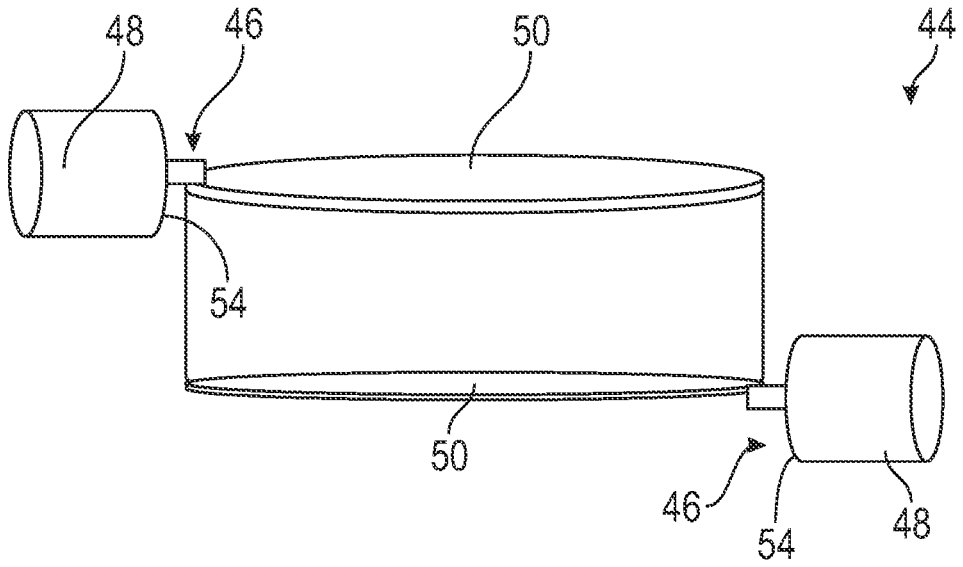
FIG. 4 is a schematic illustration of another example of an annular closing system, according to an embodiment of the disclosure.
Figure 5:
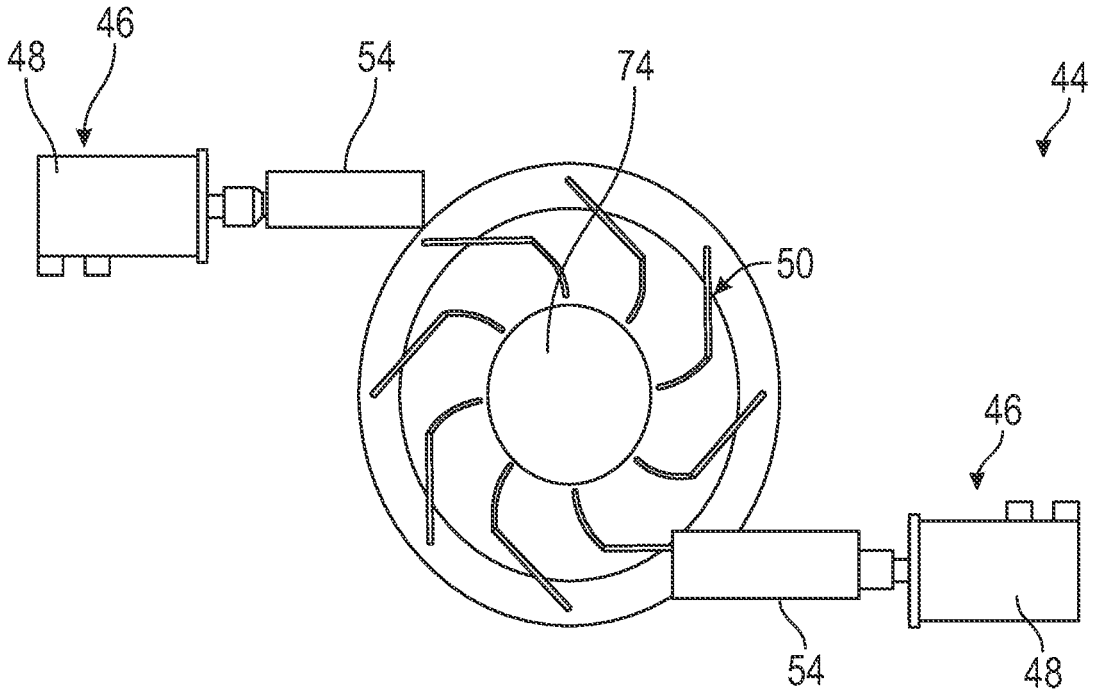
FIG. 5 is another schematic view of the annular closing system illustrated in FIG. 4, according to an embodiment of the disclosure.

According to another embodiment, the electronic actuators 46 may be electronic linear actuators, as illustrated in FIGS. 4 and 5. In this example, the electronic linear actuators 46 comprise motors 48 which drive a suitable rod, e.g. piston, linearly via a gearbox 54. The electronic linear actuators 46 are oriented to cause the desired rotation of the shift mechanism or mechanisms 50 so as to close off the BOP system central passageway when needed/desired.

Figure 6:
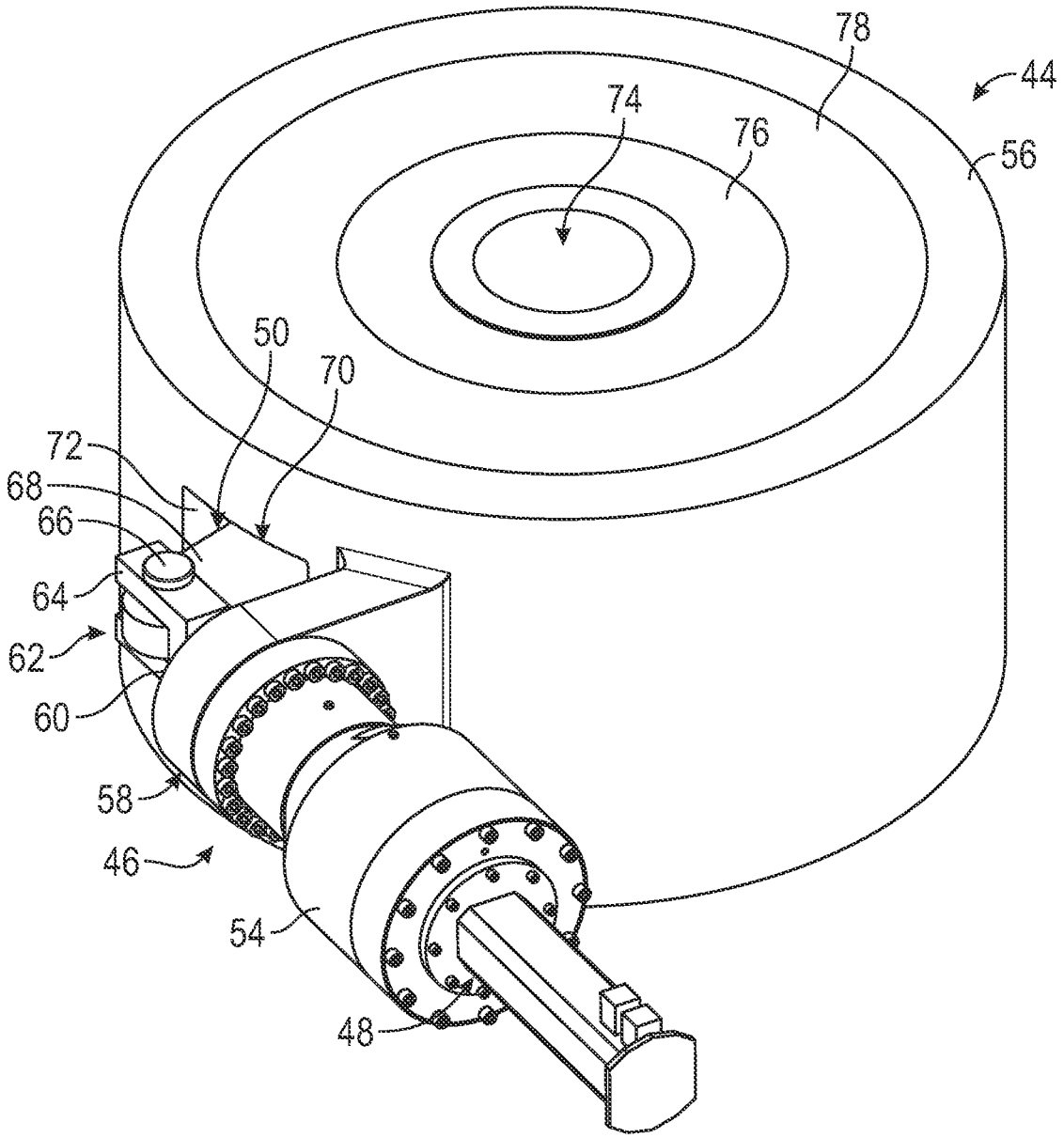
FIG. 6 is an orthogonal view of an example of an annular closing system, according to an embodiment of the disclosure.

Referring generally to FIG. 6, a more detailed example of one embodiment of annular closing system 44 is illustrated. In this example, the annular closing system 44 is in a form of electronic annular closing system powered by electronic actuator 46. A single electronic actuator 46 is illustrated, although additional electronic actuators 46 could be employed.

In this embodiment, the annular closing system 44 comprises a body 56 which forms the outer structure or outer body supporting the components of annular closing system 44. The electronic actuator 46 is mounted to body 56 via a suitable mounting structure 58, such as a flange. By way of example, the electronic actuator 46 may be a linear electronic actuator having, for example, motor 48 coupled with gearbox assembly 54 which may comprise a roller screw and nut, a gear reducer, or various other mechanisms located within a rear housing for linearly driving a rod 60, e.g. a piston. Although various types of electronic actuators 46 may be utilized, one example comprises motor 48 in which the motor output is rotational, e.g. the motor output is low torque-high rotational speed. In this example, the motor 48 is attached to gearbox assembly 54 and the gearbox transforms the low torque-high speed from the motor 48 into a high torque-low speed gearbox output. The gearbox then feeds into a roller screw (the gearbox also could feed into other screw configurations, such as a lead screw, ball screw, or other suitable screw type), and this roller screw then transfers that rotational energy/motion into the linear energy/motion of rod 60. Some devices such as a roller screw make the transfer into linear energy/motion very efficiently, whereas other devices, e.g. a lead screw, may be less efficient but provide a simpler device.

The rod 60 may be coupled with shift mechanism 50 via a coupling mechanism 62. One example of coupling mechanism 62 comprises a clevis 64 which secures a pin 66 extending through a portion 68 of shift mechanism 50.

In this particular example, shift mechanism 50 is in the form of a shift plate 70, and the shift plate portion 68 extends through a corresponding opening 72 formed generally radially through the outer body 56. The movement of portion 68 via linear actuation of electronic actuator 46 causes the shift mechanism 50/shift plate 70 to rotate about a BOP system central passageway 74, a portion of which extends through the annular closing system 44. Other components of annular closing system 44 may comprise a top 76 secured to body 56 via an actuator ring 78 or other suitable fastening mechanism.

Figure 7:
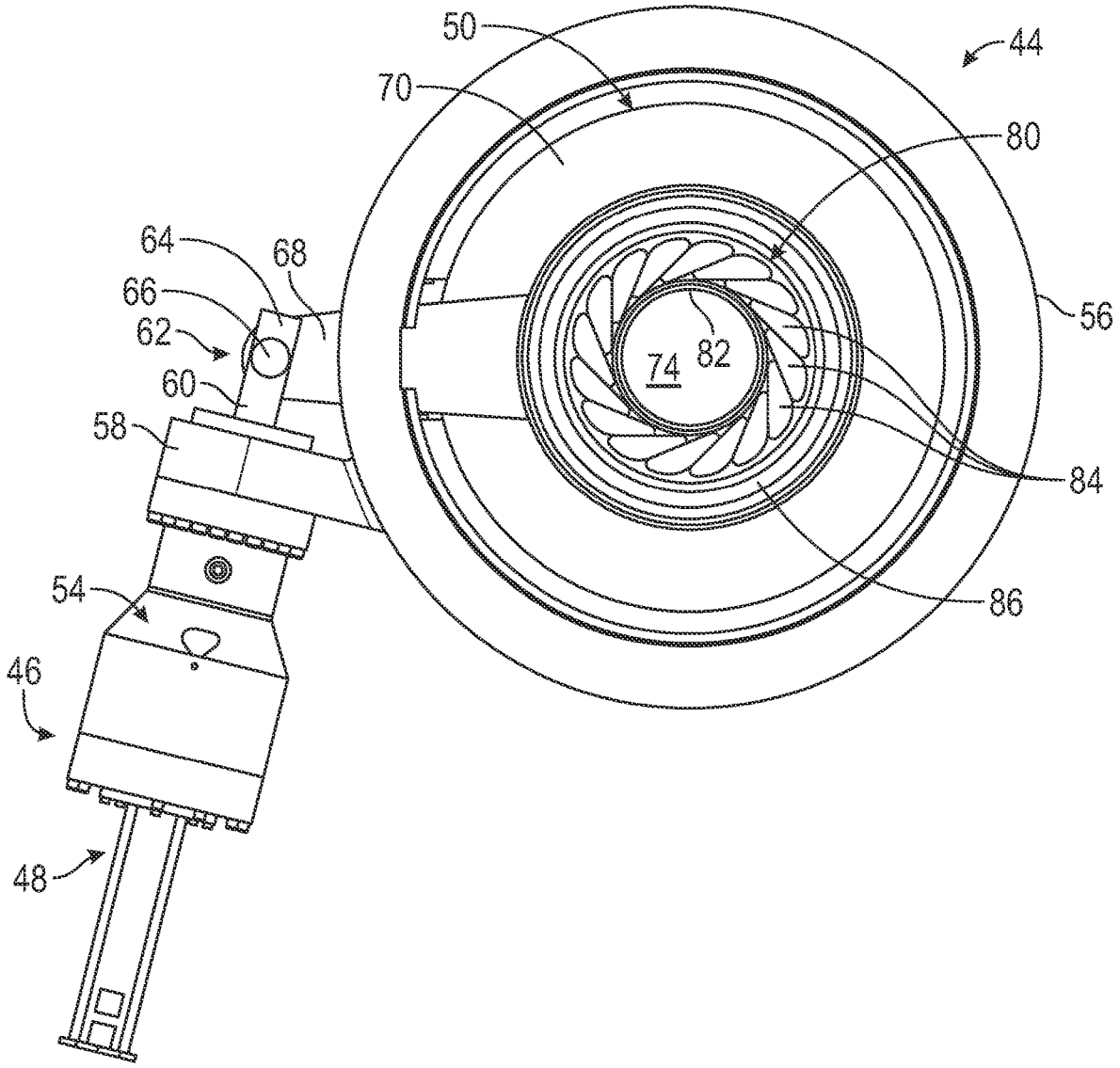
FIG. 7 is a partially broken away view of the annular closing system illustrated in FIG. 6 in an open position, according to an embodiment of the disclosure.
Figure 8:
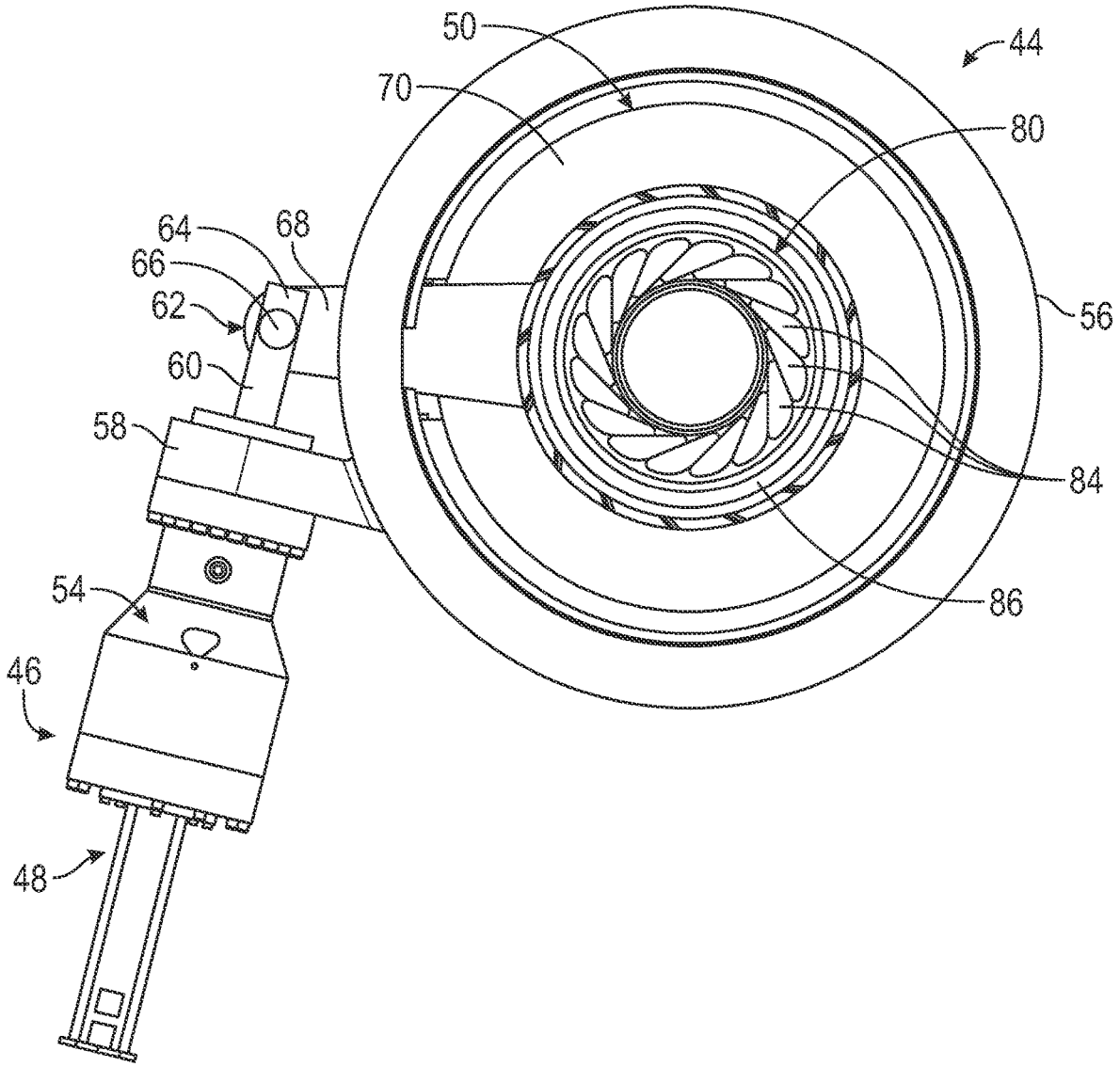
FIG. 8 is a partially broken away view of the annular closing system illustrated in FIG. 6 in a closed position, according to an embodiment of the disclosure.

The top 76 cooperates with body 56 to secure a packer 80 therein-see packer 80 illustrated in FIGS. 7 and 8. (In FIGS. 7 and 8, the top 76 and actuator ring 78 have been removed to better illustrate packer 80.) The shift mechanism 50/plate 70 also may be secured in body 56 via top 76. Packer 80 may have a variety of configurations, but one example utilizes a combination of an elastomeric sealing portion 82 and a metal portion, e.g. steel portion, formed by packer inserts 84 and/or other packer supporting structures. In some embodiments, the packer 80 may be surrounded by a donut 86 which may be formed of an elastomeric material or other suitable material which helps form a secure seal within the annular closing system 44.

As explained in greater detail below, actuation of the shift mechanism 50 via electronic actuator 46 causes the shift mechanism 50 to rotate between an open position illustrated in FIG. 7 and a closed position illustrated in FIG. 8. The rotation of shift mechanism 50 forces compression of the packer 80 inwardly so as to collapse the elastomeric sealing portion 82 of packer 80 against a tubular structure, e.g. a pipe 45, extending through BOP system central passageway 74. In many applications, the shift mechanism 50 and packer 80 are constructed for enabling sufficient inward compression so as to cause the packer 80 to seal on itself and to close off the central passageway 74 even if a tubular structure is not extending through the central passageway 74.

Figure 9:
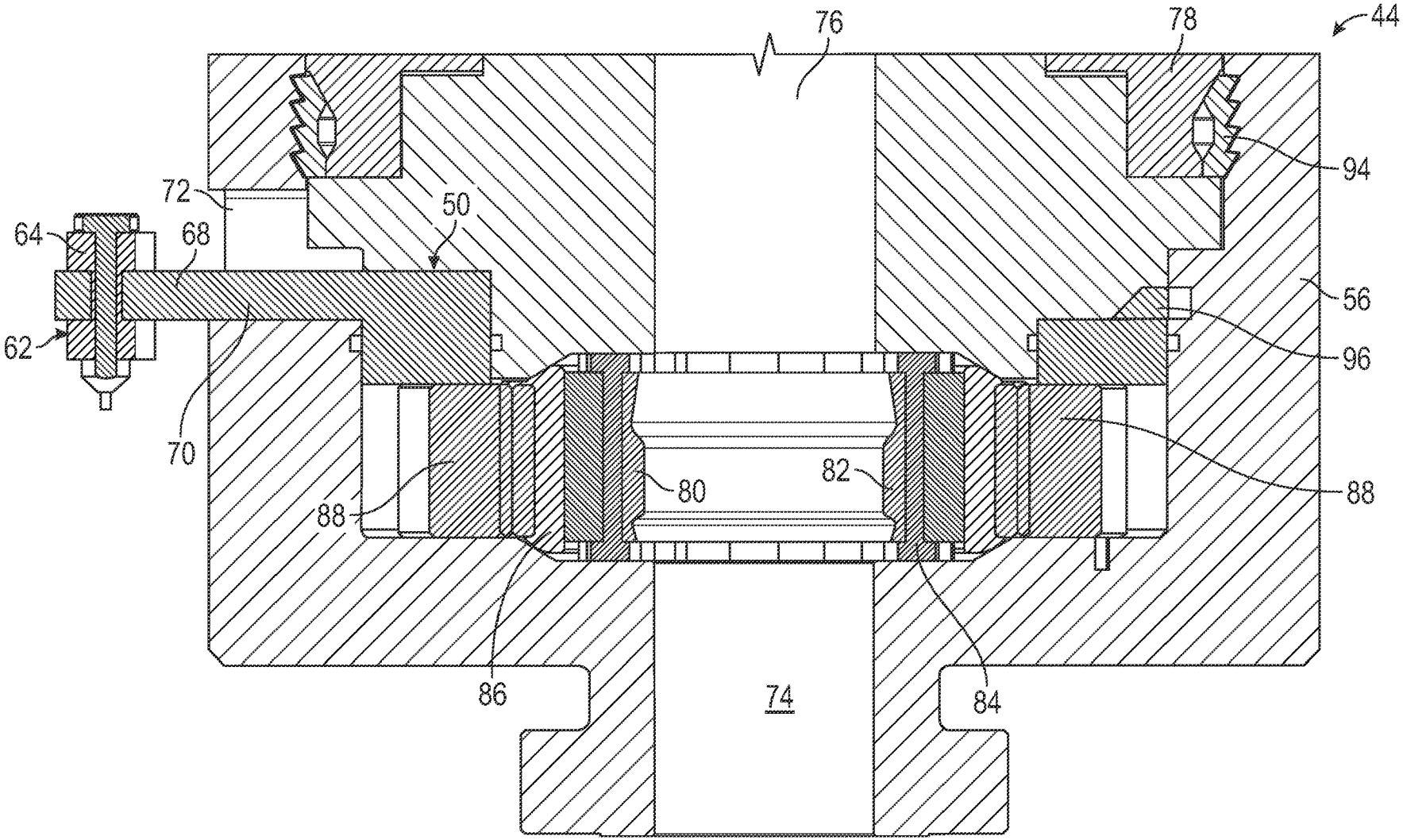
FIG. 9 is a cross-sectional view of the annular closing system, according to an embodiment of the disclosure.

Referring generally to FIG. 9, a cross-sectional illustration of annular closing system 44 is illustrated to better show some of the components as well as operation of those components. As illustrated, the annular closing system 44 comprises a plurality of inserts 88 which are shiftable to compress the packer 80 inwardly. By way of example, the inserts 88 may be positioned circumferentially around the packer 80, e.g. around the donut 86. The inserts 88 are coupled with shift mechanism 50 such that rotational movement of shift mechanism 50 forces radially inward movement of inserts 88 so as to compress donut 86 and to thus compress packer 80 in a radially inward direction.

Figure 10:
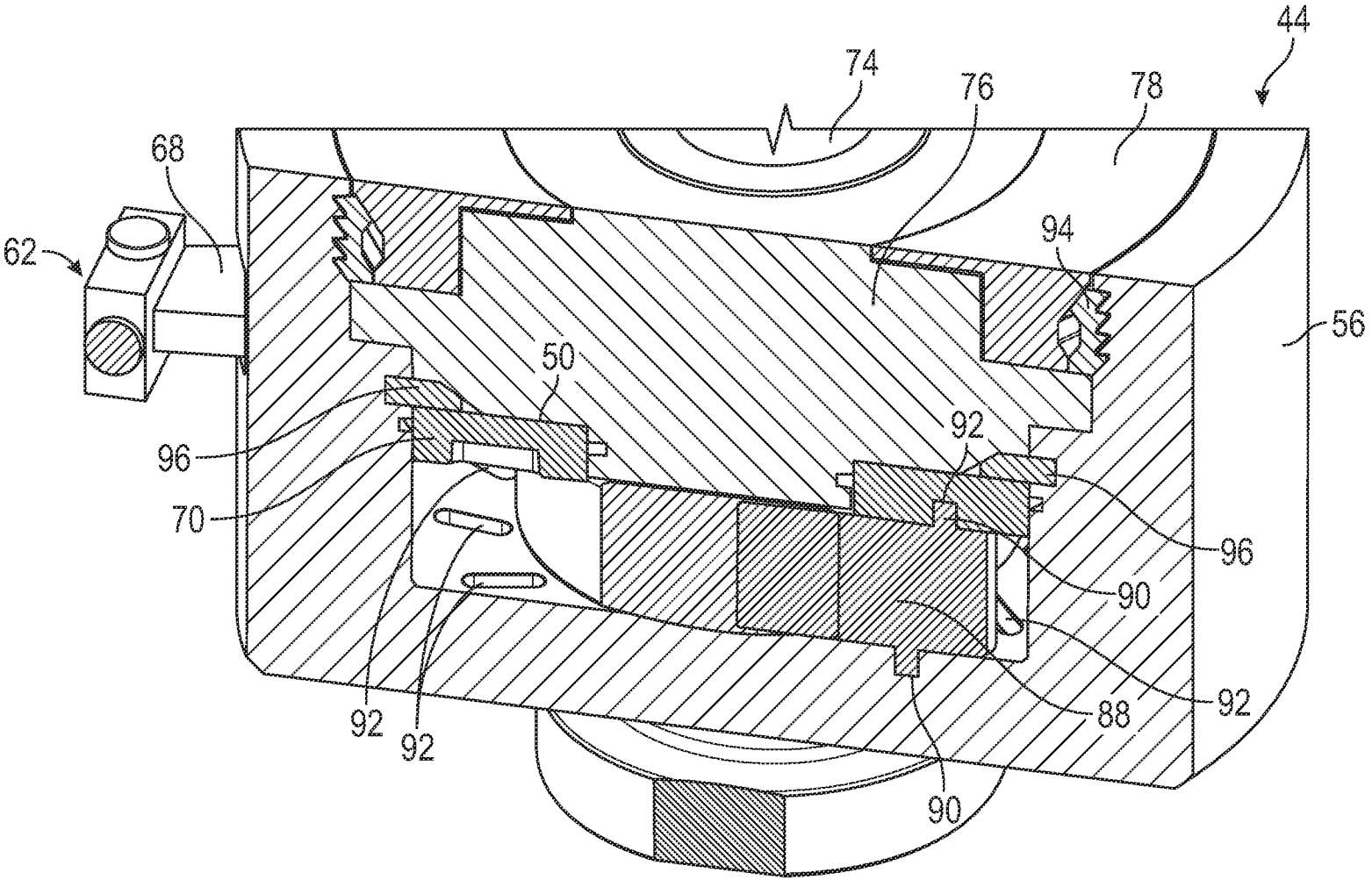
FIG. 10 is another cross-sectional view of the annular closing system, according to an embodiment of the disclosure.

With additional reference to FIG. 10, the inserts 88 may be coupled with shift mechanism 50 by a variety of coupling techniques. In the illustrated example, shift mechanism 50 is in the form of shift plate 70, and the coupling technique utilizes a plurality of pins 90 and cooperating slots 92. For example, the inserts 88 may comprise pins 90 oriented to extend into corresponding slots 92 formed in shift plate 70. The pins 90 are restricted within slots 92 such that when the shift plate 70 is rotated via electronic actuator 46, the walls of slots 92 effectively force movement of the pins 90 (and thus of the inserts 88) in a generally radially inward direction. In some embodiments, the slots 92 also may be formed in body 56 so as to provide greater stability during the shifting action.

It should be noted the annular closing system 44 may comprise various other components and features to achieve the desired actuation. The example illustrated in FIGS. 9 and 10 includes a split lock ring 94 position to secure the actuator ring 78 with respect to body 56. Additionally, various lock segments 96, seals, and other components/features may be utilized to secure and seal the various components of annular closing system 44.

Figure 11:
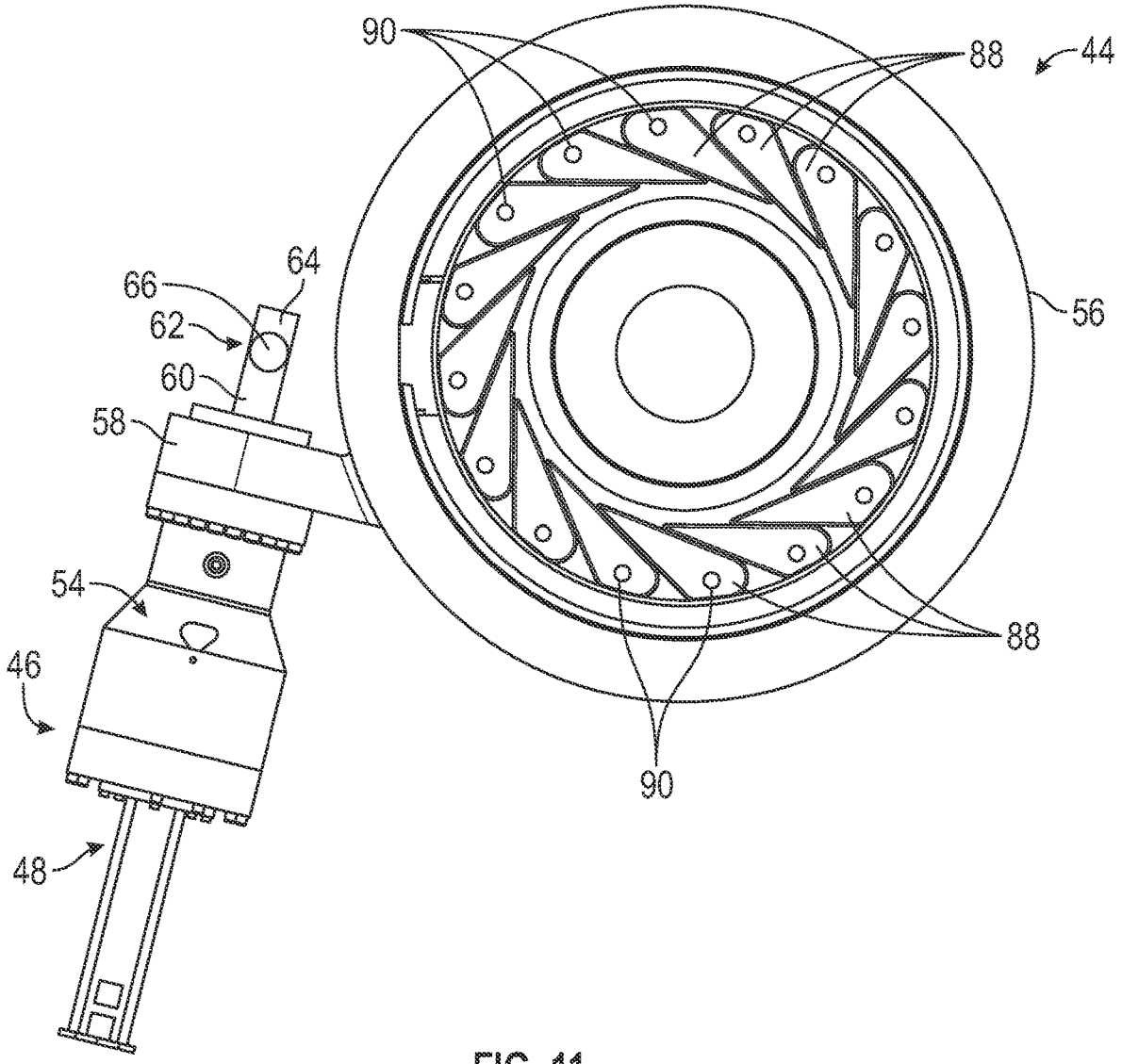
FIG. 11 is another partially broken away view of the annular closing system illustrated in FIG. 6 in an open position, according to an embodiment of the disclosure.
Figure 12:
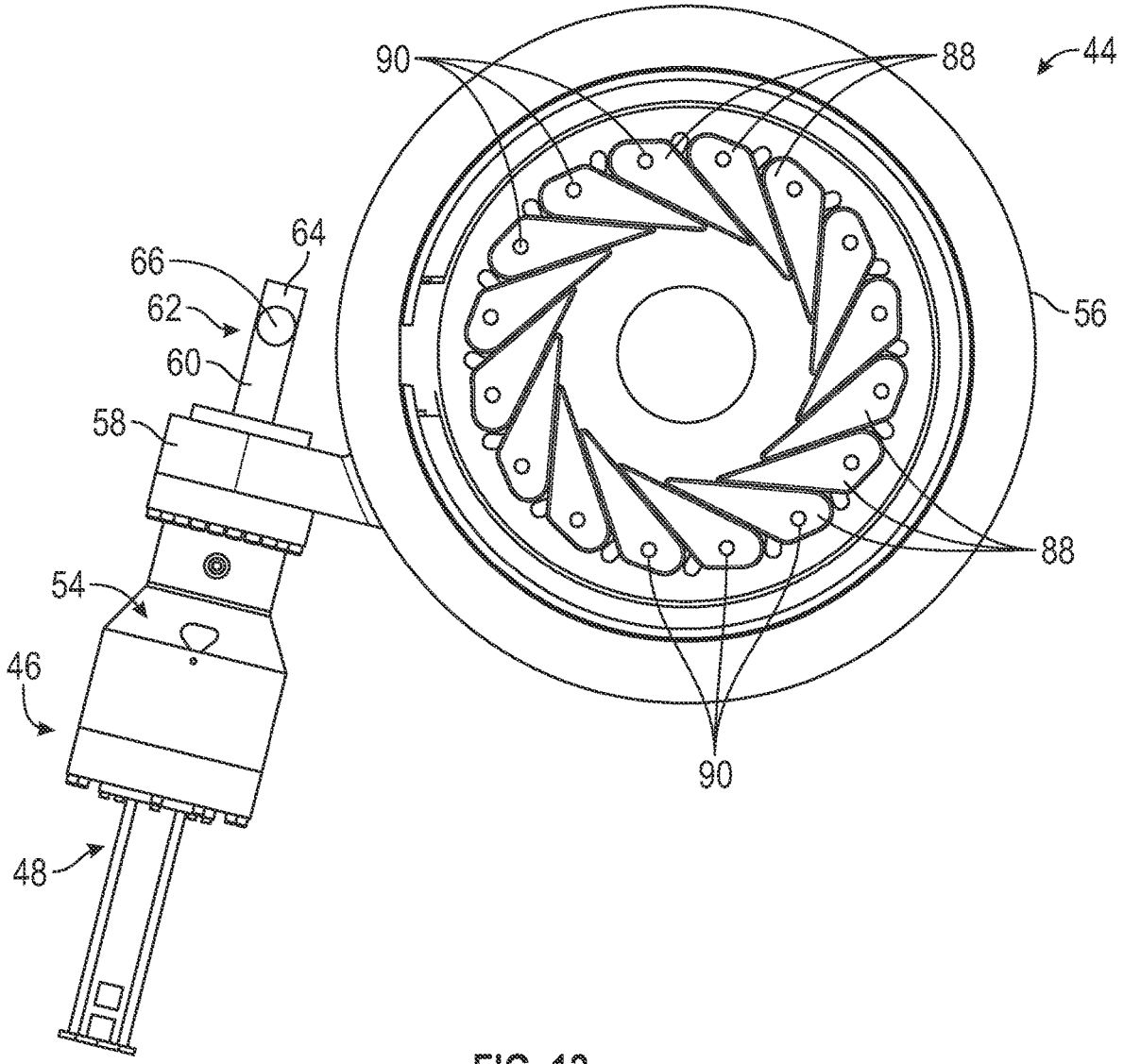
FIG. 12 is another partially broken away view of the annular closing system illustrated in FIG. 6 in a closed position, according to an embodiment of the disclosure.

As further illustrated in FIGS. 11 and 12, the inserts 88 may be arranged circumferentially around packer 80 and in a slidable relationship with respect to each other. For example, the inserts 88 may be arranged in an "iris" formation. (In FIGS. 11 and 12, the top 76, actuator ring 78, packer 80, and donut 86 have been removed to better illustrate inserts 88 arranged within body 56.) The iris formation enables the inserts 88 to slide against each other and in a radially inward direction as the shift plate 70 is rotated within body 56 to force actuation of inserts 88.

Effectively, the orientation of the slots 92 containing pins 90 forces the pins 90, and thus the inserts 88, to slide against each other so as to translate and rotate in the radially inward direction. As a result, the inserts 88 are forced from an open position illustrated in FIG. 11 to a closed position illustrated in FIG. 12. This motion, in turn, is used to force the packer 80 to compress in the radially inward direction so as to form the desired seal along the BOP system central passageway 74.

Depending on the specific well operation, well environment, and well equipment, the overall well system 30 may be adjusted and various configurations may be employed. For example, the BOP system 32 may comprise many types of alternate and/or additional components. Additionally, the BOP system 32 may be combined with many other types of wellheads and other well components used in subsea hydrocarbon production operations or other types of operations.

Furthermore, the components and arrangement of annular closing system 44 may vary according to the parameters of a given environment and/or well operation. For example, the electric actuation may be achieved by single electronic actuators 46 or by a plurality of cooperating electronic actuators 46. Electronic actuators 46 may comprise motors 48 or other electrically powered mechanisms to provide the desired actuation motion. The shift mechanism 50 may be a single mechanism or a plurality of mechanisms acting against a single packer 80 or a plurality of packers 80. The electrically actuated, radially inward compression of the packer(s) 80 may be achieved by various arrangements of inserts 88 or by other types of lever mechanisms, expansion mechanisms, or other suitable mechanisms able to achieve sufficient compression of packer(s) 80 so as to close off the central passageway 74. Similarly, the size, arrangement, materials, and interaction of the various components of annular closing system 44 may be adjusted according to the parameters of a given operation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for preventing blowouts at a well, comprising:
- a blowout preventer (BOP) system having an annular closing system mounted on a plurality of ram BOPs, the annular closing system comprising:
  - a packer configured to be compressed inwardly to seal off flow along an interior passage of the BOP system;
  - a rotatable shift mechanism configured to selectively cause the packer to compress inwardly upon sufficient rotation of the rotatable shift mechanism;
  - a plurality of slidable inserts positioned between the packer and the rotatable shift mechanism and shiftable by the rotatable shift mechanism to compress the packer inwardly;
  - a donut positioned between the packer and the plurality of slidable inserts and configured to facilitate uniform compression of the packer by compression of the donut via shifting of the plurality of slidable inserts; and
  - an electronic actuator coupled to the rotatable shift mechanism and configured to enable selective rotation of the rotatable shift mechanism.

2. The system as recited in claim 1, wherein the packer comprises an elastomeric sealing portion.

3. The system as recited in claim 2, wherein the packer is mounted in a body of the annular closing system.

4. The system as recited in claim 3, wherein the plurality of slidable inserts are arranged around the circumference of the packer.

5. The system as recited in claim 3, wherein the rotatable shift mechanism includes a shift plate, and wherein the shift plate is coupled to the plurality of slidable inserts via pins and slots arranged to receive the pins.

6. The system as recited in claim 5, wherein the pins extend from the plurality of slidable inserts and the slots are formed in both the shift plate and the body.

7. The system as recited in claim 3, wherein the rotatable shift mechanism includes a shift plate, and wherein the packer and the shift plate are secured in the body by a top mounted to the body via an actuator ring.

8. The system as recited in claim 1, wherein the BOP system is mounted on a wellhead.

9. The system as recited in claim 1, wherein the electronic actuator is an electronic linear actuator.

10. The system as recited in claim 9, wherein the electronic linear actuator comprises a motor driving a gearbox to move a rod linearly.

11. A method, comprising:
- constructing a BOP system with an annular closing system mounted on a plurality of ram BOPs;
- providing the annular closing system with a packer able to compress inwardly to seal off flow along an interior passage of the BOP system;
- employing a rotatable shift mechanism to selectively cause the packer to compress inwardly upon sufficient rotation of the rotatable shift mechanism;
- positioning a plurality of slidable inserts between the packer and the rotatable shift mechanism, and positioning a donut between the packer and the plurality of slidable inserts to facilitate uniform compression of the packer by compression of the donut; and coupling at least one electronic actuator to the rotatable shift mechanism to power selective rotation of the rotatable shift mechanism.

12. The method as recited in claim 11, further comprising forming the packer with an elastomeric element combined with a plurality of metal packer inserts.

* * * * *